US009911523B2

(12) United States Patent
Xu et al.

(10) Patent No.: US 9,911,523 B2
(45) Date of Patent: Mar. 6, 2018

(54) GROUNDING BODY FORMING METHOD

(71) Applicant: Jian Xu, Harbin, Heilongjiang (CN)

(72) Inventors: Jian Xu, Harbin (CN); Bochen Xu, Harbin (CN)

(73) Assignee: Jian Xu, Harbin (CN)

( * ) Notice: Subject to any disclaimer, the term of this patent is extended or adjusted under 35 U.S.C. 154(b) by 219 days.

(21) Appl. No.: 14/653,032

(22) PCT Filed: Dec. 17, 2013

(86) PCT No.: PCT/CN2013/089638

§ 371 (c)(1),
(2) Date: Jun. 17, 2015

(87) PCT Pub. No.: WO2014/094589

PCT Pub. Date: Jun. 26, 2014

(65) Prior Publication Data

US 2016/0196900 A1 Jul. 7, 2016

(30) Foreign Application Priority Data

Dec. 17, 2012 (CN) ..... 2012 1 0548308

(51) Int. Cl.
*H01B 13/00* (2006.01)
*H01R 4/66* (2006.01)
*H01B 1/04* (2006.01)

(52) U.S. Cl.
CPC ..... *H01B 13/0036* (2013.01); *H01B 1/04* (2013.01); *H01R 4/66* (2013.01)

(58) Field of Classification Search
CPC .... H01L 2933/0016; H01L 2933/0025; H01B 1/04; H01B 13/0036; H01R 4/66
See application file for complete search history.

(56) References Cited

U.S. PATENT DOCUMENTS 7,371,452 B2 * 5/2008 Bourdelais ..... G02B 6/1221 174/95
7,655,159 B2 * 2/2010 Murray ..... C02F 1/46109 252/500

(Continued)

FOREIGN PATENT DOCUMENTS

CN 101515485 A 8/2009
CN 101752021 A 6/2010

(Continued)

OTHER PUBLICATIONS

Chinese Office Action issued in corresponding application No. 2014061000589790 dated Jun. 13, 2014.

(Continued)

*Primary Examiner* — Carl Arbes
(74) *Attorney, Agent, or Firm* — Carter, Deluca, Farrell & Schmidt, LLP

(57) ABSTRACT

A method and system for forming ground electrodes are provided, the method includes: metal conductors are laid in grooves that are dug out on a ground surface; conductive solution is prepared, with the conductive solution consisting of 0.1%-0.5% of amylocellulose, 15%-24.9% of high conductivity carbon powders, 15%-24.9% of gel material, and 60%-70% of water, by weight percentage; and the conductive solution is poured into the grooves, wherein the conductive solution forms conductive gel after solidifying, which wraps up a part of the metal conductor contained in the groove. The system for forming grounding electrodes includes: an excavating equipment, a setup equipment, a solution preparation equipment and a pouring and molding equipment. The method and system for forming ground electrodes can make the discharging effect of lightning currents better.

6 Claims, 4 Drawing Sheets

(56) References Cited

U.S. PATENT DOCUMENTS

| | | | | |
|---|---|---|---|---|
| 8,062,734 | B2 * | 11/2011 | Kaminsky | H05K 3/107 174/95 |
| 8,158,095 | B2 * | 4/2012 | Yoshinaga | B01J 20/20 252/511 |
| 2007/0208130 | A1 * | 9/2007 | Sasahara | A61B 5/04087 524/521 |

FOREIGN PATENT DOCUMENTS

| | | | |
|---|---|---|---|
| CN | 101877437 | A | 11/2010 |
| CN | 102983421 | A | 3/2013 |
| CN | 203039216 | U | 7/2013 |
| GB | 906338 | A | 9/1962 |
| JP | 1-143163 | A | 6/1989 |

OTHER PUBLICATIONS

Chinese Office Action issued in corresponding application No. 2014102201053930 dated Oct. 27, 2014.
International Search Report issued in corresponding application No. PCT/CN2013/089638 dated Mar. 13, 2014.

* cited by examiner

GROUNDING BODY FORMING METHOD

TECHNICAL FIELD

This disclosure relates to the lightning protection technology field, especially to a method and system for forming grounding electrodes, i.e. the grounding body forming method and system.

BACKGROUND ART

In the modern lightning protection technology field, the grounding grid is critical factor to the success of the lightning protection process. The grounding grid is a lightning current discharging network consisting of a main ground lead and several grounding electrodes (grounding bodies). Here, the grounding electrodes are conductors buried underground with one end connecting to the main ground lead and the other end buried underground (connecting to the ground). To illustrate the applications of the grounding grid, a tower for supporting transmission lines is used as example. The tower is generally made of metal material. When the tower is struck by lightning, lightning currents are discharged into the grounding grid, where the currents are transmitted to individual grounding electrodes via the main ground lead, thereby being discharged into the ground via the individual grounding electrodes. The great amount of the electric charges carried by the lightning currents are neutralized with the opposite charges in the ground so as to discharge the lightning currents, which achieves the purpose of lightning protection.

Currently, the grounding grid uses the grounding electrode, which structurally comprises: metal rods and metalloid blocks of definite shape, for example graphite blocks. The metal rod has one end inserted into the graphite block and the other end connecting to the main ground lead of the grounding grid.

Nowadays, the environment of the site where a grounding grid is needed to be setup is generally complex, for example, a rocky area. Hard rocks have the electrical resistivity relatively high and the conductivity performance poor, so it is required that the grounding grid has higher conductivity property However, the grounding electrodes being used in the existing grounding grids are partially metalloid blocks definite shape, which have small contact surface area with the rocks after being buried into the rocks, thereby causing the lightning currents cannot be discharged into the rocks or ground rapidly through the metalloid blocks definite shape. In such cases, electric charges resulted from the lightning currents cannot be neutralized with opposite charges in the ground quickly, so making the discharging effect of lightning currents poor.

SUMMARY

The present invention provides a method and system for forming grounding electrodes, capable of producing more effective lightning discharging effect.

To achieve the purposes stated above, the technical solution of the invention is as follows:

The method for forming grounding electrodes consists of the following:

metal conductors are laid in grooves that are dug out on the ground surface;

conductive solution is prepared, with the conductive solution consisting of 0.1%-0.5% of amylocellulose, 15%-24.9% of high conductivity carbon powder, 15%-24.9% of gel materials, and 60%-70% of water, by weight percentage;

the conductive solution is poured into the grooves, wherein the conductive solution forms conductive gel after solidifying, which wraps up a part of the metal conductor contained in the groove, so as to form the grounding electrode.

Preferably, the groove is in the shape of cube, invented wedge or cylinder.

Preferably, the PH of the prepared solution ranges from 7 to 8.

Preferably, the gel material contains acrylamide, methylene-bisacrylamide, potassium persulfate, and triethanolamine.

In addition, in weight percentage, the gel material consists of 40%-50% of acrylamide, 15%-30% of methylene-bisacrylamide, 8%-20% of potassium persulfate, and 12%-25% of triethanolamine.

Preferably, the granularity of said high conductivity carbon powders is larger than 1000 mesh.

Preferably, the carbon content of said high conductivity carbon powders is greater than 95%.

The present invention also provides a system for forming grounding electrodes, which consists of the following:

an excavating equipment, which is configured for digging grooves on the ground;

a setup equipment, which is configured for laying metal conductors in the grooves;

a solution preparation equipment, which is configured for preparing conductive solution; and a pouring and moulding equipment, which is configured for pouring the prepared conductive solution into the grooves, wherein the conductive solution forms conductive gel after solidifying and the conductive gel wraps up a part of the metal conductor contained in the grooves, so as to forming the grounding electrode.

Preferably, the thickness of the conductive gel wrapping the metal conductor is greater than 2 cm.

Preferably, it further comprises conductive rods, wherein the conductive rod has one end connected with the metal conductor and the other end inserted into the groove, and wherein when the conductive gel is formed, the conductive rod is wrapped with the conductive gel.

Preferably, the conductive rod is a metal rod or a carbon rod.

Compared to the prior art, in the method and system for forming grounding electrodes according to the present invention, firstly a metal conductor is laid in the grooves dug out on the ground, and then the conductive solution is prepared. The prepared conductive solution is conductive due to the high conductivity carbon powders contained therein. And the conductive solution is thickened due to the amylocellulose contained in the conductive solution, allowing the high conductivity carbon powders dispersing in suspension state evenly in the solution, thereby giving the conductive solution higher conductivity. Moreover, both rocks and common soil have gaps therein, therefore when the conductive solution is poured into the grooves, the conductive solution would permeate into the nearby ground along these gaps. Thanks to the gel material contained in the conductive solution, the conductive solution would slowly solidify to form gel during a certain time of period, and further form grounding electrodes. And the conductive gel formed by the solidified conductive solution wraps up the part of the metal rod located within the groove, such that after passing through the metal conductor, lightning currents enter the conductor gel and sufficiently contact with the ground through the conductive gel which permeates into the gaps in the ground. Compared to the existing art in which the lightning currents are discharged to the ground only through the metalloid block of definite shape that is buried underground and the contact area between the metalloid block and the ground is limited which is impossible to rapidly discharge the lightning currents, in the present invention, a forming method is adopted, in which the conductive solution permeates to the gaps in the ground, such that the contact area between the conductive solution and the ground is enlarged, and moreover when the lightning currents pass through the conductive gel formed by the solidified conductive solution, the electric charges resulted from the lightning currents can contact more opposite charges during a short time, therefore the lightning currents may discharged rapidly, achieving a better discharging effect of the lightning currents.

BRIEF DESCRIPTION OF DRAWINGS

For better illustration of embodiments of the present invention and technical solutions of the prior art, figures mentioned during describing the embodiments or the prior art will be explained briefly. Obviously, the figures mentioned below illustrate some embodiments of the present invention. As for one skilled in the art, other figures may be obtained based on these figures without inventive labor paid.

DETAILED DESCRIPTION OF EMBODIMENTS

To make purposes, technical solutions and advantages of the embodiments of the present invention clearer, the technical solutions of the embodiments of the present invention will be described clearly and completely. It is obvious that the described embodiments are part of the embodiments of the present invention, instead of all the embodiments. Based on the embodiments of the present invention, any other embodiments one skilled in the art obtains without inventive labor are covered by the protection scope of the present invention.

Embodiment 1

Figure 1:
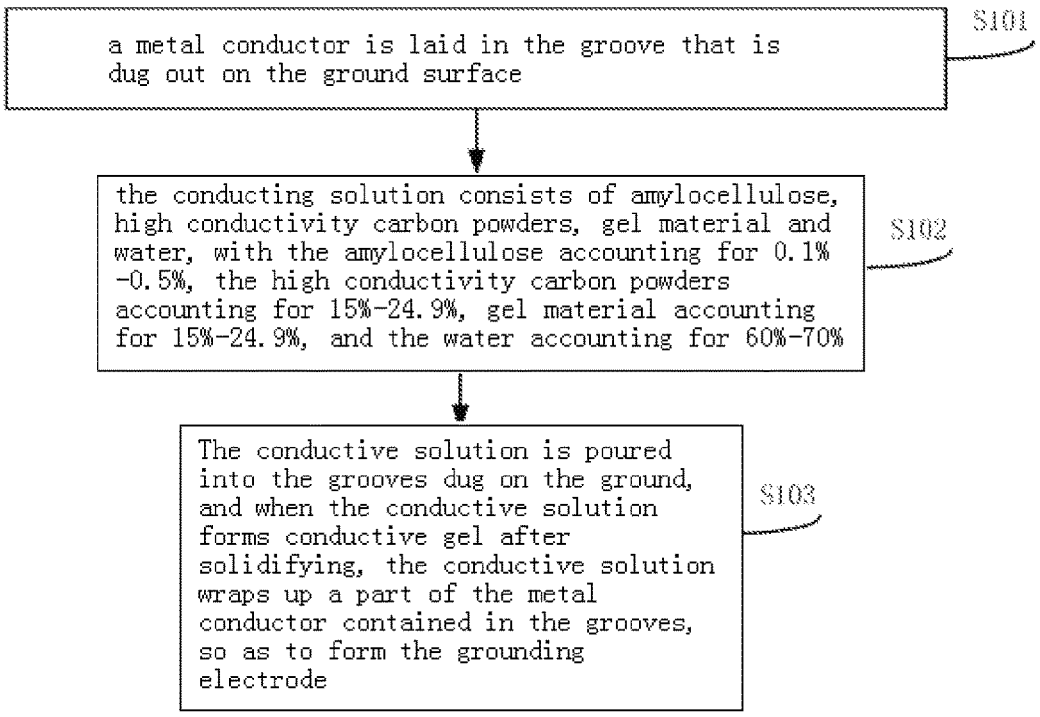
FIG. 1 shows a flow chart of a method for forming a grounding electrode according to Embodiment 1 of the present invention.

Embodiment 1 of the present invention provides a method for forming grounding electrodes. Referring to FIG. 1, the method comprises:

Step S101: a metal conductor is laid in the groove that is dug out on the ground surface, wherein the metal conductor is taken as the main ground lead of the grounding grid.

Step S102: Conductive solution is prepared, wherein the conductive solution consists of amylocellulose, high conductivity carbon powders, gel material and water, with the amylocellulose accounting for 0.1%-0.5%, the high conductivity carbon powders accounting for 15%-24.9%, gel material accounting for 15%-24.9%, and the water accounting for 60%-70%.

Step S103: The conductive solution is poured into the grooves dug on the ground, and when the conductive solution forms conductive gel after solidifying, the conductive solution wraps up a part of the metal conductor contained in the grooves, so as to form the grounding electrode;

In the method for forming grounding electrodes of the present invention, firstly a metal conductor is laid in the grooves dug out on the ground and then the conductive solution is prepared. Here, the conductive solution is conductive due to the high conductivity carbon powders contained in the solution. And the solution is thickened due to the amylocellulose contained therein, allowing the high conductivity carbon powders dispersing in suspension evenly in the solution, thereby giving the liquid solution higher conductivity. Moreover, both rocks and common soil have gaps therein, therefore when the conductive solution is poured into the grooves, the conductive solution would permeate into the nearby ground along these gaps. Thanks to the gel material contained in the conductive solution, the conductive solution would slowly solidify to form gel during a certain time of period, and further form grounding electrodes. And the conductive gel formed by the solidified conductive solution wraps up the part of the metal rod located within the groove, such that after passing through the metal conductor, lightning currents enter the conductor gel and sufficiently contact with the ground through the conductive gel which permeates in the gaps in the ground. Compared to the existing art in which the lightning currents are discharged to the ground only through the metalloid block of definite shape that is buried underground and the contact area between the metalloid block and the ground is limited which is impossible to rapidly discharge the lightning currents, in the present invention, a forming method is adopted in which the conductive solution permeates to the gaps in the ground, such that the contact area between the conductive solution and the ground is enlarged, and moreover when the lightning currents pass through the conductive gel formed by the solidified conductive solution, the electric charges resulted from the lightning currents can contact more opposite charges during a short time, therefore the lightning currents may discharged rapidly, achieving a better discharging effect of the lightning currents.

For better illustration of the method for forming grounding electrodes of Embodiment 1 of the present invention, Embodiment 2 is provided as a preferable embodiment.

Embodiment 2

Figure 2:
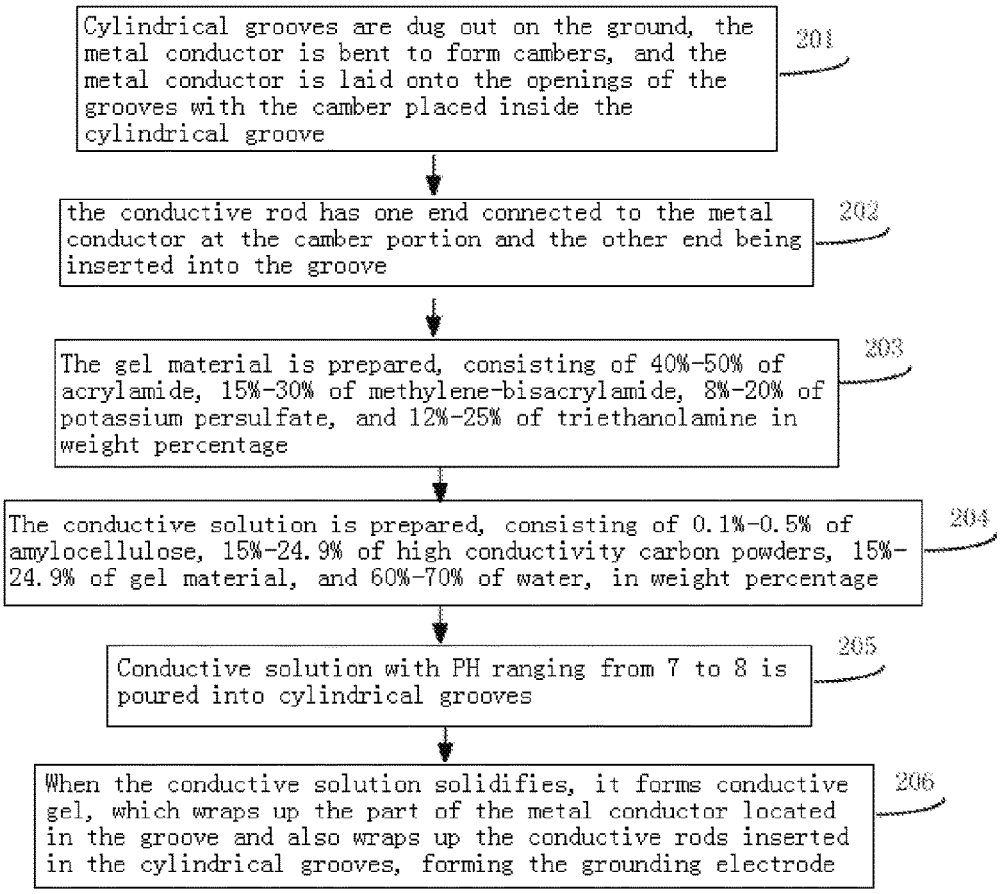
FIG. 2 shows a flow chart of another method for forming grounding electrodes according to Embodiment 2 of the present invention.

Embodiment 2 of the present invention provides another method for forming grounding electrodes. In the method, the grooves dug on the ground could be in cuboid, cylindrical, or inverted wedge shape or any other irregular shape. The metal conductor is bent into more than one cambers spaced from each other, which are each located in the groove when the metal conductor is laid in more than one grooves, thereby creating more than one grounding electrodes for forming a grounding grid. In addition, the gel material may comprise 4 substances, i.e., acrylamide, methylene-bisacrylamide, potassium persulfate, and triethanolamine. Particularly, in the present embodiment, cylindrical grooves are chosen as the example. Referring to FIG. 2, the method comprises:

Step 201: Cylindrical grooves are dug out on the ground, the metal conductor is bent to form cambers, and the metal conductor is laid onto the openings of the grooves with the camber placed inside the cylindrical groove, wherein the metal conductor could be made of round steel or galvanized flat steel.

The grounding electrodes formed by the method according to the present embodiment can be used in a grounding grid. The metal conductor serves as the main grounding lead of the grounding grid. The metal conductor may form more than one cambers, which are each laid in more than one grooves dug in the ground, such that the cambers are located in the grooves, so as to form more than one grounding electrodes, thereby creating the grounding grid;

Considering economic efficiency and saving the usage of conductive solution, the cylindrical grooves can be made deeper with the cross section area being smaller however.

Generally, cuboid grooves are provided for the grounding electrodes applied in the geographical condition of ordinary regions. Cylindrical grooves are provided for special geographical conditions where the grounding electrode needs to be buried in large depth. Inverted-wedge grooves are provided for the grounding electrodes applied in sandstone or rocks environments.

Step 202: the conductive rod has one end connected to the metal conductor at the camber portion and the other end being inserted into the groove, wherein the conductive rod could be either a metal rod or a carbon rod; and if the conductive rod is a metal rod, for example a round steel or flat steel member, the metal rod has one end welded with the metal conductor and the other end inserted into the dug groove; and when the conductive rod is a carbon rod, one end of the carbon rod is clamped on the camber portion of the metal conductor, and the other end thereof is inserted into the groove.

Step 203: The gel material is prepared, consisting of 40%-50% of acrylamide, 15%-30% of methylene-bisacrylamide, 8%-20% of potassium persulfate, and 12%-25% of triethanolamine in weight percentage, wherein the gel material which mainly consists of the acrylamide has stable chemical properties, which will not corrode with galvanized metal.

Step 204: The conductive solution is prepared, consisting of 0.1%-0.5% of amylocellulose, 15%-24.9% of high conductivity carbon powders, 15%-24.9% of gel material, and 60%-70% of water, in weight percentage.

In Step 204, firstly the amylocellulose is added into the water to make the water thickened for the purpose of unique dissolution of the high conductivity carbon powders; then the high conductivity carbon powders are added into the liquid to disperse evenly in the solution in suspension state, followed by adding the gel material to obtain the solution after sufficient mixing. The conductive solution can stay stable even through being exposed to air for three days, due to the addition of the amylocellulose;

in addition, carbon atoms are in the chainlike distribution in the carbon powders, producing the high conductivity; and to achieve further better conductivity of the conductive solution, the high conductivity carbon powders with granularity greater than 1000 mesh and the carbon content of greater than 95% is preferred.

Step 205: Conductive solution with PH ranging from 7 to 8 is poured into cylindrical grooves;

wherein as the conductive solution with PH ranging from 7 to 8 is alkalescent, a passive film can be formed on the metal surface, for protecting the wrapped metal conductor and the rod inserted in the groove from be corroded by soil materials. Moreover, it can be known from experimental data that the corrosion rate of the metal conductor is less than 0.002 mm/year when used in various geographic environments if the metal electrode is produced by the method for forming metal electrodes according to the present invention.

both rocks and common soil, called medium, have gaps therein, therefore when the conductive solution is poured into the cylindrical grooves, the conductive solution would permeate into the ground along these gaps, which called "tree root effect", which in turn makes the contact area between the conductive solution and the earth enlarged. When the lightning currents are passing through the conductive gel formed by the conductive solution via the metal conductor, since the conductive gel spreads throughout the gaps in the ground, the electric charges resulted from the lightning currents can contact more opposite charges in the ground during a short time, then the electric charges resulted from the lightning currents are neutralized, achieving a better discharging effect of the lightning currents, and in addition, such Tree Root Effect can effectively decrease the grounding resistance of the medium.

Step 206: When the conductive solution solidifies, it forms conductive gel, which wraps up the part of the metal conductor located in the groove and also wraps up the conductive rods inserted in the cylindrical grooves, forming the grounding electrode, wherein the thickness of the conductive gel wrapping the metal conductor is greater than 2 cm; and in addition, the conductive gel, which is made using the material in the present embodiment, has very good hygroscopic property. It can maintain water content of greater than 50%, which further guarantees the good conductivity of the conductive gel.

In the method for forming grounding electrodes according to the present invention, due to the "tree root effect", the conductive solution permeates into the nearby ground along the gaps in the medium, increasing the contact area between the conductive solution and the nearby ground. After passing through the metal conductor, lightning currents sufficiently contact with the ground through the conductive gel which permeates into the gaps in the medium. Compared to the existing art in which the lightning currents are discharged to the ground only through the metalloid block of definite shape that is buried underground and the contact area between the metalloid block and the ground is limited which is impossible to rapidly discharge the lightning currents, in the present invention, a forming method is adopted, in which the conductive solution permeates to the gaps in the ground, such that the contact area between the conductive solution and the ground is enlarged, and moreover when the lightning currents pass through the conductive gel formed by the solidified conductive solution, the electric charges resulted from the lightning currents can contact more opposite charges during a short time, therefore the lightning currents may discharged rapidly, achieving a better discharging effect of the lightning currents and decreasing the grounding resistance of the rock areas;

in addition, as the conductive solution with PH ranging from 7 to 8 is alkalescent, a passive film can be formed on the metal surface, for protecting the wrapped metal conductor and the rod inserted in the groove from be corroded by soil, and moreover, it can be known from experimental data that the corrosion rate of the metal conductor is less than 0.002 mm/year when used in various geographic environments if the metal eletrode is produced by the method for forming metal electrodes according to the present invention.

In the meantime, the amylocellulose is contained in the conductive solution, to make the water thickened in advance, thereby facilitating evenly suspension and dissolution of the high conductivity carbon powders. It prevents the high conductivity carbon powders from being deposited after being added, which could negatively affect the conductivity of the solution. Therefore, the addition of the amylocellulose further ensures the good conductive performance of the conductive solution.

Embodiment 3

Figure 3:
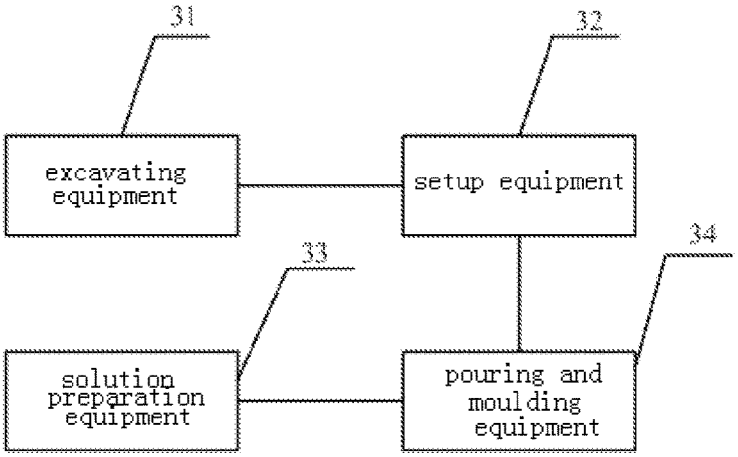
FIG. 3 shows a structural view of a system for forming the grounding electrode according to Embodiment 3 of the present invention.

As for the method for forming grounding electrodes mentioned above, Embodiment 3 of the present invention provides a system for forming grounding electrodes, as shown in FIG. 3. The system consists of the following:

an excavating equipment 31, which is configured for digging grooves on the ground;

wherein the groove is in the shape of cube, cylinder, invented wedge or other irregular shapes;

a setup equipment 32, which is configured for laying metal conductors in the grooves;

a solution preparation equipment 33, which is configured for preparing conductive solution;

Preferably, the conductive solution consists of 0.1%-0.5% of amylocellulose, 15%-24.9% of high conductivity carbon powder, 15%-24.9% of gel materials, and 60%-70% of water in weight percentage;

Further, the gel material, which preferably mainly consists of the acrylamide, has stable chemical properties, which will not corrode with galvanized metal. To be specific, the gel material consists of 40%-50% of acrylamide, 15%-30% of methylene-bisacrylamide, 8%-20% of potassium persulfate, and 12%-25% of triethanolamine in weight percentage;

A pouring and moulding equipment 34, which is configured for pouring the conductive solution into the grooves, wherein the conductive solution forms conductive gel after solidifying and the conductive gel wraps up a part of the metal conductor contained in the grooves, so as to forming the grounding electrode.

Figure 4:
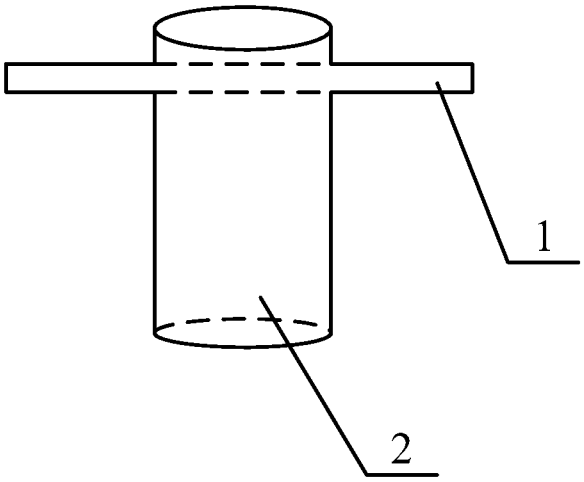
FIG. 4 shows a structural view of the grounding electrode formed in Embodiment 3 of the present invention.

Specifically, FIG. 4 shows the structure of the grounding electrode formed by the above forming system, where the grounding electrode consists of a metal conductor 1 and conductive gel 2. The metal conductor 1 passes through the conductive gel 2.

When the grounding electrode is used in the grounding grid, the metal conductor 1, used as the main ground lead in the ground grid, is laid on the ground surface, while the conductive gel 2 is buried under the ground.

In addition, in order that the metal conductor can be sufficiently wrapped by the conductive gel, the metal conductor has camber (arc shape) located inside the grooves, and then when the conductive solution is poured into the grooves, the camber portion on the metal conductor is sufficiently wrapped by the conductive solution.

Conductivity rods are used for better conductive performance. The metal conductor is connected to one end of the conductive rod, with the other end of the conductive rod being inserted into the groove. As the conductive gel is formed, the conductivity rods are wrapped with the conductive gel;

In addition, the thickness of the conductive gel wrapping the metal conductor is greater than 2 cm.

The conductivity rod can be a metal rod or a carbon rod.

If the conductivity rod is a metal rod, it can be made of round steel or flat steel, with one end of the rod welded with the arc portion of the metal conductor 1, while the other end being inserted into conductive gel 2.

If the conductivity rod is carbon rod, one end of the carbon rod is clamped onto the arc portion of the metal conductor 1 using a clamp tool, with the other end thereof being inserted into the conductive gel 2.

Figure 5:
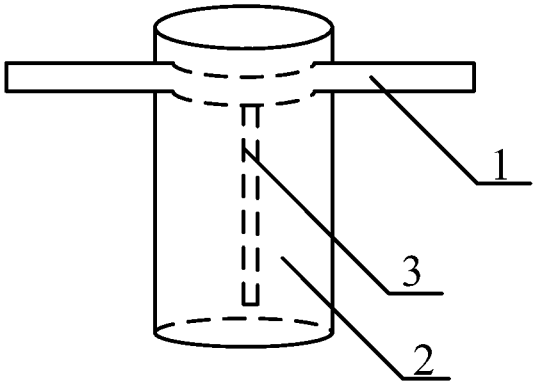
FIG. 5 shows a structural view of a grounding electrode formed in cylinder shape.

Three different structures of electrical electrodes formed by the forming system comprising conductivity rods are listed below:

FIG. 5 shows the structure of the grounding electrode formed using the cylindrical shape, which consists of a metal conductor 1, conductive gel 2 and a conductivity rod 3:

The metal conductor 1 has the camber portion, and is going through conductive gel 2, where the camber portion of the metal conductor is located inside the conductive gel 2. The conductive gel 2 fully wraps up the camber portion of the metal conductor 1. The conductivity rod 3 has one end connected with the metal conductor 1 and the other end being inserted into conductive gel 2.

In addition, considering economic efficiency and saving the usage of conductive solution, the cylindrical grooves can be made deeper with the cross section area being smaller however.

Figure 6:
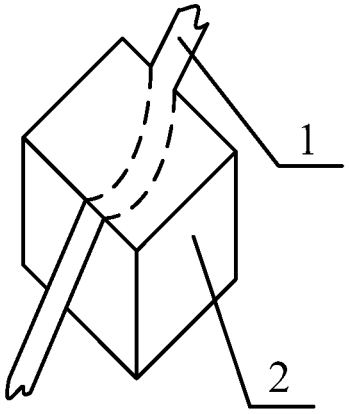
FIG. 6 shows a structural view of a grounding electrode formed in cuboid shape.

FIG. 6 shows the structure of the grounding electrode formed using cuboid shape. This type of grounding electrode is commonly applied in regular environments, because such environments require lower resistance for grounding electrodes. Therefore, for economic efficiency purpose, conductivity rods are not necessary to be connected with the metal conductor, in other words, the grounding electrode generally only consists of the metal conductor and conductive gel for this situation.

Figure 7:
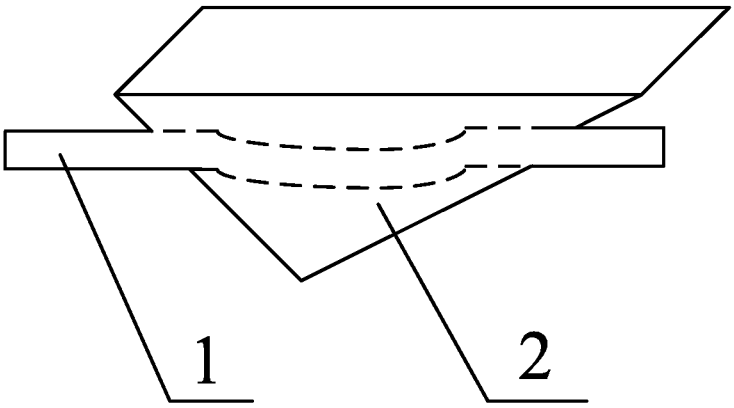
FIG. 7 shows a structural view of a grounding electrode formed in inverted wedge shape.

FIG. 7 shows the structure of the grounding electrode formed using the inverted wedge shape, which is generally applied in rock areas. The shape of the conductive gel is designed as inverted wedge, which saves the usage of raw materials. The inverted-wedge shaped grounding electrode generally only consists of metal conductor and conductive gel, without using the conductivity rods.

The grounding electrode formed by the system for forming grounding electrodes of the present invention can be applied to a grounding grid. More than one grooves are dug on the ground and the metal conductor is bent to form more than one cambers spaced from each other, which are each laid in the grooves, thereby creating the grounding grid.

Last but not least, the embodiments mentioned above are only to better illustrate the technical solutions of this invention, rather than limit the same. One skilled in the art should understand that the technical solutions of the embodiments mention above may be modified or some technical features thereof may be replaced, with all these modifications and replacements covered by the protection scope of the present invention.

The invention claimed is:

1. A method for forming grounding electrodes, comprising:

laying metal conductors in grooves that are dug out on a ground surface;

preparing a conductive solution consisting of 0.1%-0.5% of amylocellulose, 15%-24.9% of high conductivity carbon powders, 15%-24.9% of gel material, and 60%-70% of water, by weight percentage; and pouring the conductive solution into the grooves, wherein the conductive solution forms a conductive gel after solidifying, which wraps up a part of the metal conductors contained in the grooves, so as to form the grounding electrode.

2. The method for forming grounding electrodes according to claim 1, wherein the grooves are a shape selected from the group consisting of a cube, a cylinder, and an invented wedge.

3. The method for forming grounding electrodes according to claim 1, wherein the prepared conductive solution has a PH value ranging from 7 to 8.

4. The method for forming grounding electrodes according to claim 1, wherein the conductive solution contains acrylamide, methylene-bisacrylamide, potassium persulfate, and triethanolamine, and wherein, in weight percentage, the conductive gel consists of 40%-50% of acrylamide, 15%-30% of methylene-bisacrylamide, 8%-20% of potassium persulfate, and 12%-25% of triethanolamine.

5. The method for forming grounding electrodes according to claim 1, wherein the high conductivity carbon powders have granularity larger than 1000 mesh.

6. The method for forming grounding electrodes according to claim 1, wherein the high conductivity carbon powders have carbon content greater than 95%.

* * * * *